US007980890B2

(12) United States Patent
Gibson et al.

(10) Patent No.: US 7,980,890 B2
(45) **Date of Patent: *Jul. 19, 2011**

(54) ADHESIVE LAMINATE LABEL FOR A COMMUNICATION CONNECTOR JACK AND COMMUNICATION CONNECTOR JACK AND COMMUNICATIONS DEVICES INCLUDING SAME

(75) Inventors: Adam Gibson, Lynnwood, WA (US); Keith Kosanovich, Mill Creek, WA (US); Max Banakar, Bellevue, WA (US)

(73) Assignee: Leviton Manufacturing Co., Inc., Melville, NY (US)

( * ) Notice: Subject to any disclaimer, the term of this patent is extended or adjusted under 35 U.S.C. 154(b) by 142 days.

This patent is subject to a terminal disclaimer.

(21) Appl. No.: 12/485,770

(22) Filed: Jun. 16, 2009

(65) Prior Publication Data

US 2009/0260268 A1 Oct. 22, 2009

Related U.S. Application Data

(63) Continuation-in-part of application No. 12/148,709, filed on Apr. 21, 2008, now Pat. No. 7,547,227.

(51) Int. Cl.
*H01R 3/00* (2006.01)

(52) U.S. Cl. ..... 439/491; 283/81

(58) Field of Classification Search ..... 439/488, 439/491; 40/5; 361/824, 825, 826; 385/134; 283/81, 101

See application file for complete search history.

(56) References Cited

U.S. PATENT DOCUMENTS

| | | | | | |
|---|---|---|---|---|---|
| 2,041,097 | A | | 5/1936 | Vierling | |
| 2,388,431 | A | | 11/1945 | Neiman | |
| 2,431,999 | A | | 12/1947 | Engelhardt | |
| 2,549,419 | A | | 4/1951 | Callahan | |
| 3,409,347 | A | | 11/1968 | Vogel | |
| 3,989,338 | A | * | 11/1976 | Gosser | 439/43 |
| 4,780,573 | A | * | 10/1988 | Own | 174/66 |
| 4,820,193 | A | | 4/1989 | Noorily | |
| 5,051,870 | A | | 9/1991 | Companion | |
| 5,284,363 | A | * | 2/1994 | Gartner et al. | 283/81 |

(Continued)

FOREIGN PATENT DOCUMENTS

JP 05-033412 U 4/1993

(Continued)

OTHER PUBLICATIONS

International Search Report Dated Feb. 28, 2011, for International Patent Application No. PCT/US2010/038806 Filed Jun. 16, 2010.

(Continued)

*Primary Examiner* — Neil Abrams
(74) *Attorney, Agent, or Firm* — Kathryn M. Milam; Paul F. Rusyn; Graybeal Jackson LLP

(57) ABSTRACT

An embodiment of the invention is directed to an adhesive laminate label for a communications device. The adhesive laminate label includes an upper label including visible indicia and at least one lower label. Each of the lower labels includes corresponding visible indicia that are different than the visible indicia of the upper label and of the other lower labels. At least the visible indicia of each lower label are covered by either the upper label or one of the other lower labels and the upper and lower labels are removably adhered to one another.

46 Claims, 12 Drawing Sheets

U.S. PATENT DOCUMENTS

| | | | | |
|---|---|---|---|---|
| 5,380,045 | A | 1/1995 | Comann | |
| 5,538,438 | A | 7/1996 | Orlando | |
| 5,611,691 | A * | 3/1997 | Poulain | 434/224 |
| 5,613,874 | A | 3/1997 | Orlando et al. | |
| 5,765,698 | A * | 6/1998 | Bullivant | 211/26 |
| 5,983,539 | A | 11/1999 | Martin et al. | |
| 6,017,229 | A | 1/2000 | Tulley et al. | |
| 6,135,505 | A | 10/2000 | Fendt et al. | |
| 6,215,067 | B1 | 4/2001 | Chen | |
| 6,305,950 | B1 | 10/2001 | Doorhy | |
| 6,337,836 | B1 | 1/2002 | Eidelson | |
| 6,371,793 | B1 | 4/2002 | Doorhy et al. | |
| 6,416,339 | B1 | 7/2002 | Snow et al. | |
| 6,461,189 | B1 | 10/2002 | Koh | |
| 6,478,611 | B1 | 11/2002 | Hyland | |
| 6,496,884 | B1 | 12/2002 | Friesen | |
| 6,520,544 | B1 | 2/2003 | Mitchell et al. | |
| 6,722,563 | B1 | 4/2004 | Johnson et al. | |
| 6,752,431 | B1 * | 6/2004 | Matthews et al. | 283/81 |
| 6,786,776 | B2 | 9/2004 | Itano et al. | |
| 6,814,624 | B2 | 11/2004 | Clark et al. | |
| 6,831,569 | B2 | 12/2004 | Wang | |
| 6,974,352 | B2 | 12/2005 | Clark et al. | |
| 7,119,708 | B2 | 10/2006 | Newell | |
| 7,161,556 | B2 | 1/2007 | Morgan et al. | |
| 7,211,163 | B2 | 5/2007 | Kennedy | |
| 7,270,565 | B2 | 9/2007 | Kamata et al. | |
| 7,306,492 | B2 | 12/2007 | Clark et al. | |
| 7,357,249 | B1 * | 4/2008 | Weber | 206/308.1 |
| 7,424,785 | B2 * | 9/2008 | Feroli et al. | 40/649 |
| 7,547,227 | B1 | 6/2009 | Gibson et al. | |
| 7,581,843 | B2 | 9/2009 | Stauner | |
| 7,585,191 | B2 * | 9/2009 | Hawley et al. | 439/676 |
| 7,740,282 | B2 | 6/2010 | McNutt et al. | |
| 7,756,380 | B2 * | 7/2010 | Ruiz et al. | 385/135 |
| 2002/0194725 | A1 | 12/2002 | Perea, Jr. et al. | |
| 2004/0026918 | A1 | 2/2004 | Piana | |
| 2004/0154196 | A1 | 8/2004 | Miyake | |
| 2004/0163837 | A1 | 8/2004 | Price | |
| 2005/0057353 | A1 | 3/2005 | Barrieau | |
| 2006/0059757 | A1 | 3/2006 | Didulo | |
| 2006/0084323 | A1 | 4/2006 | Clark et al. | |
| 2007/0121323 | A1 | 5/2007 | Pawlik et al. | |
| 2007/0227053 | A1 | 10/2007 | Miyake | |
| 2007/0238352 | A1 | 10/2007 | Deng | |
| 2008/0272586 | A1 | 11/2008 | Hick et al. | |
| 2009/0300959 | A1 | 12/2009 | McNutt et al. | |
| 2010/0095572 | A1 * | 4/2010 | Laursen et al. | 40/661 |

FOREIGN PATENT DOCUMENTS

| | | | |
|---|---|---|---|
| JP | 10172362 | A | 6/1998 |
| JP | 2007-174750 | A | 7/2007 |
| KR | 200283068 | Y1 | 7/2002 |

OTHER PUBLICATIONS

Written Opinion Dated Feb. 28, 2011, for International Patent Application No. PCT/US2010/038806 Filed Jun. 16, 2010.

U.S. Appl. No. 60/916,196, filed May 4, 2007, Applicant: Maddox.

* cited by examiner

ADHESIVE LAMINATE LABEL FOR A COMMUNICATION CONNECTOR JACK AND COMMUNICATION CONNECTOR JACK AND COMMUNICATIONS DEVICES INCLUDING SAME

PRIORITY CLAIM

The present application is a Continuation-In-Part of U.S. patent application Ser. No. 12/148,709, filed Apr. 21, 2008, now U.S. Pat. No. 7,547,227, issued Jun. 16, 2009, which application is incorporated herein by reference in its entirety.

BACKGROUND

A modular communication connector jack is a receptacle that accepts a communication plug. Common communication connector jacks include Category 5, 5e, 6, 6a, or 10G electrical connector jacks that are configured to accept a communication plug, such as a voice/data/video plug. For example, such communication connector jacks may be configured to accept a communication plug from a communication cable, such as an Ethernet cable. Typically, such communication connector jacks are used to electrically interconnect telecommunication equipment.

Communication connector jacks of this type typically include an electrically insulating housing that supports a plurality of electrical terminals at which electrical conductors of a multi-conductor cable are terminated. For example, many commercially available communication connector jacks employ insulation displacement contacts, and each electrical conductor may be terminated at one of the insulation displacement contacts using a specially designed termination tool.

For proper functioning of a communication connector jack, it is important that each conductor of the multi-conductor cable is correctly paired, sequenced, and terminated at a correct one of the electrical terminals of the communication connector jack. Incorrect termination and subsequent connection to telecommunications equipment can impede the functioning of and can cause damage to such telecommunications equipment. Furthermore, incorrect termination of the multi-conductor cable can cause costly and timely troubleshooting.

SUMMARY

An embodiment of the invention is directed to an adhesive laminate label for a communications device. The adhesive laminate label includes an upper label including visible indicia and at least one lower label. Each of the lower labels includes corresponding visible indicia that are different than the visible indicia of the upper label and of the other lower labels. At least the visible indicia of each lower label are covered by either the upper label or one of the other lower labels and the upper and lower labels are removably adhered to one another.

DETAILED DESCRIPTION

Embodiments of the invention relate to an adhesive laminate label that includes an upper label having a first termination diagram (e.g., a T568B termination diagram) that covers a second termination diagram (e.g., a T568A termination diagram) of a lower label, and a modular communication connector jack including such an adhesive laminate label. The disclosed adhesive laminate label embodiments enable an installer to select which one of the upper and lower labels is visible to provide a visual aid so that the installer can correctly terminate signal lines (e.g., electrical conductors of a multi-conductor cable or optical fibers) at signal-line terminals of a modular communication connector jack in accordance with a termination diagram on the selected one of the upper and lower labels in view.

Figure 1:
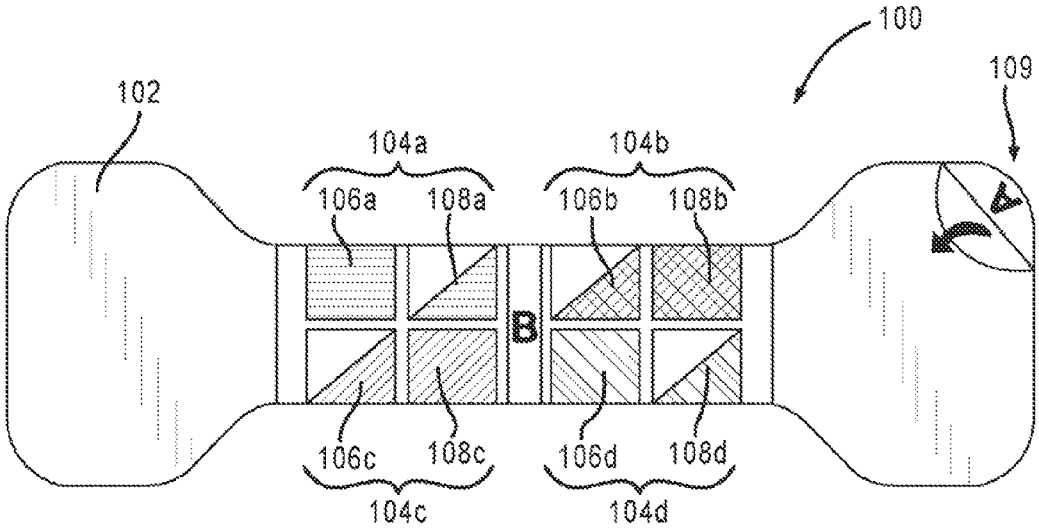
FIG. 1 is a top plan view of an adhesive laminate label, according to one embodiment of the invention, including an upper label having a first termination diagram.

FIG. 1 is a top plan view of an adhesive laminate label 100 according to one embodiment of the invention. The adhesive laminate label 100 includes an upper label 102 having a first plurality of color-coded symbol pairs 104*a*-104*d* arranged to represent a first termination diagram for terminating signal lines of a multi-signal-line cable at signal-line terminals of a modular communication connector jack. For example, in the illustrated embodiment, the first termination diagram is in accordance with the T568B wiring standard and a symbol (e.g., the letter "B" in the illustrated embodiment) may be provided on the upper label 102 to represent that the first termination diagram is in accordance with the T568B wiring standard. It should be noted that the use of the T568B wiring standard is merely one example for the first termination diagram and other termination diagrams are contemplated.

Still referring to FIG. 1, each symbol pair 104*a*-104*d* includes a corresponding color-coded symbol 106*a*-106*d* and a corresponding color-coded symbol 108*a*-108*d*. The type of cross-hatching or lack thereof used to represent each color-coded symbol 106*a*-106*d* and 108*a*-108*d* represents the color. For example, in the T568B wiring standard, the color-coded symbols 106*a*-106*d* may be blue, white/orange, white/brown, and green, respectively, and the color-coded symbols 108*a*-108*d* may be white/blue, orange, brown, and white/green, respectively. As will be discussed in more detail with respect to FIGS. 4-11, each color-coded symbol pair 104*a*-104*d* may be color coded to correspond with a pair of signal lines of a multi-signal-line cable, such as a pair of electrical conductors of a multi-conductor cable to be terminated at a modular communication connector jack to which the adhesive laminate label 100 is adhered.

Figure 2:
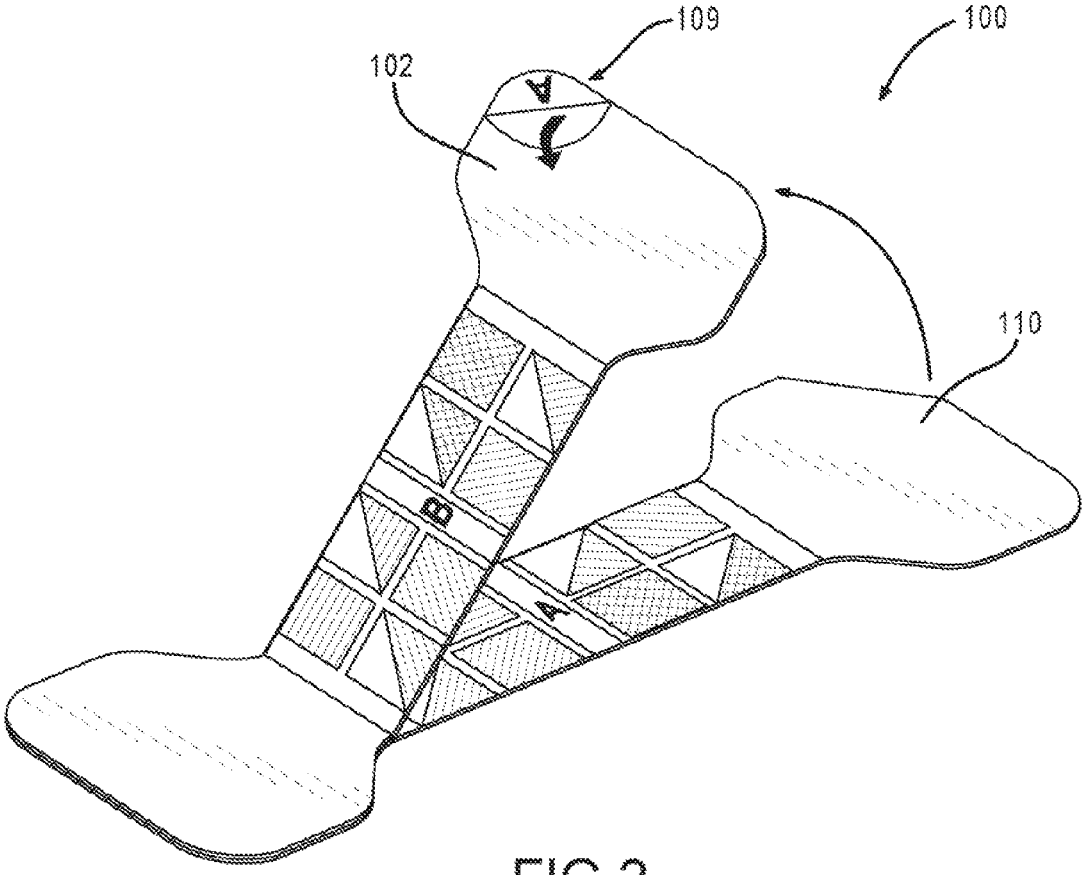
FIG. 2 is an isometric view of the adhesive laminate label shown in FIG. 1 illustrating the upper label being removed from an underlying lower label.

Referring to the isometric view of the adhesive laminate label 100 shown in FIG. 2, the adhesive laminate label 100 includes at least one underlying lower label 110 that is at least partially covered by the upper label 102. For example, the upper label 102 may be removably adhered to the lower label 110. The upper label 102 and lower label 110 may each be formed from a number of well-known polymeric materials. Further, a back side of the upper label 102 may include a pressure-sensitive adhesive or an adhesive backing for adhering it to the underlying lower label 110, and a back side of the lower label 110 may employ the same or similar adhesives or adhesive backing for adhering it to a connector body of a modular communication connector jack. Thus, the back side of the lower label 110 includes an adhesive in some embodiments of the adhesive laminate label 100 for adhering the adhesive laminate label to a communications device. In other embodiments of the adhesive laminate label 100 the back side of the lower label 110 does not include an adhesive, with the adhesive laminate label being attached to the associated communications device through other suitable techniques in such embodiments. For example, the adhesive laminate label 100 could be sized such that when inserted between rows of IDCs on a communication device the adhesive laminate label is held in place by pressure applied to the adhesive laminate label by the IDCs. Alternatively, the communications device could include suitable slots or guides into which the adhesive laminate label is inserted to attach the label to the device. Note that where the lower label 110 does not include an adhesive its back side, the back side of the upper label 102 still includes such an adhesive of course for removably adhering the upper label to the lower label.

Still referring to FIG. 2, the upper label 102 may be manually peeled off of the lower label 110. A marking 109 positioned on the upper label 102, such as a corner thereof, may indicate the presence of a second termination diagram on the underlying lower label 110. For example, in the illustrated embodiment, the marking 109 is a letter "A" that indicates that the second termination diagram on the lower label 110 is in accordance with the T568A wiring standard. However, any other suitable marking may be used.

It is also noted that although the adhesive laminate label 100 is illustrated as including only one lower label 110, in other embodiments of the invention, the adhesive laminate label 100 may include two or more lower labels each of which may have a different respective termination diagram thereon that is different than that of the first termination diagram on the upper label 102.

Figure 3:
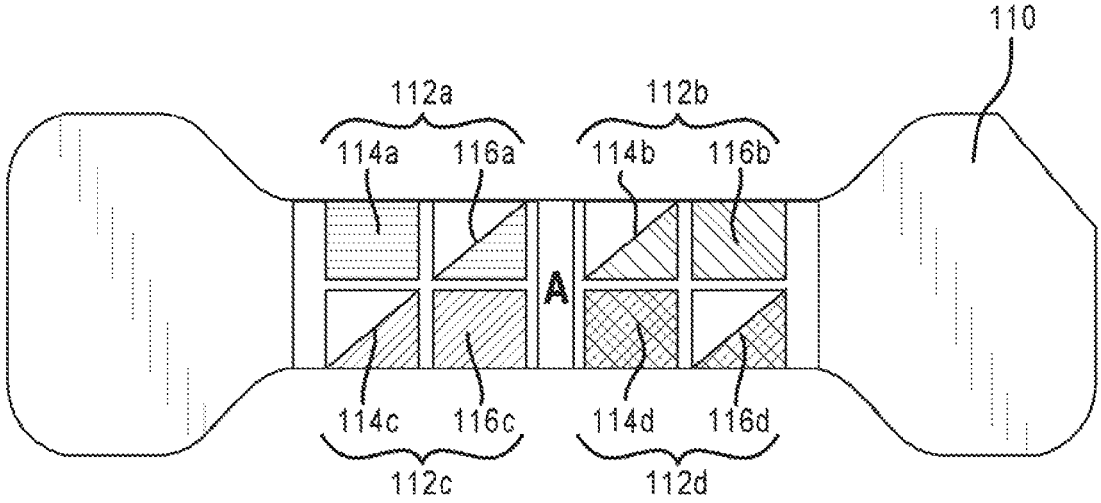
FIG. 3 is a top plan view of a lower label of the adhesive laminate label after removal of the upper label shown in FIGS. 1 and 2 that includes a second termination diagram that is different from the first termination diagram.

FIG. 3 is a top plan view of the lower label 110 after removal of the upper label 102. The lower label 110 includes a second plurality of color-coded symbol pairs 112*a*-112*d* arranged to represent the second termination diagram for terminating electrical conductors of a multi-conductor cable at electrical terminals of a modular communication connector jack. The second termination diagram is different than that of the first termination diagram of the upper label 102. For example, in the illustrated embodiment, the second termination diagram may be in accordance with the T568A wiring standard, and a symbol (e.g., the letter "A" in the illustrated embodiment) may be provided on the lower label 110 to represent that the second termination diagram is in accordance with the T568A wiring standard. It should be emphasized that the use of the T568A wiring standard is merely one example for the second termination diagram and other termination diagrams are contemplated. Prior to removal of the upper label 102, the second plurality of color-coded symbol pairs 112*a*-112*d* representing the second termination diagram are concealed by and not substantially visible through the upper label 102.

Still referring to FIG. 3, each symbol pair 112*a*-112*d* includes a corresponding color-coded symbol 114*a*-114*d* and a corresponding color-coded symbol 116*a*-116*d*. Again, the type of cross-hatching or lack thereof used to represent each color-coded symbol 114*a*-114*d* and 116*a*-116*d* represents the color. For example, in the T568A wiring standard, the color-coded symbols 114*a*-114*d* may be blue, white/green, white/brown, and orange, respectively, and the color-coded symbols 116*a*-116*d* may be white/blue, green, brown, and white/orange, respectively. As will be discussed in more detail with respect to FIGS. 4-11, each color-coded symbol pair 112*a*-112*d* may be color coded to correspond with a pair of signal lines of a multi-signal-line cable (e.g., electrical conductors of a multi-conductor cable) to be terminated at a modular communication connector jack on which the adhesive laminate label 100 is positioned.

The adhesive laminate label 100 allows an installer of a communication connector jack to select between multiple (e.g., at least two) different termination diagrams for terminating signal lines of a multi-signal-line cable, such as electrical conductors, at signal-line terminals of a modular communication connector jack. When the communication connector jack is to be terminated according to the first termination diagram on the upper label 102 of the adhesive laminate label 100, the installer can leave the upper label 102 in place adhered to and concealing the second termination diagram on the underlying lower label 110. When the communication connector jack is to be terminated according to the second termination diagram on the lower label 110 of the adhesive laminate label 100, the installer may manually peel the upper label 102 off of the underlying lower label 110 to expose the lower label 110 and the second termination diagram thereof.

It is noted that in the illustrated embodiment of the adhesive laminate label 100 shown in FIGS. 1-3, each of the color-coded symbols 106*a*-106*d*, 108*a*-108*d*, 114*a*-114*d*, and 116*a*-116*d* is given a particular color or combination of colors. However, in other embodiments of the invention, symbols besides color-coded symbols may be used. In another embodiment, individual letters may be used to represent a particular color. For example, the color-coded symbol 106*a* may be replaced with a letter "B" for blue or another suitable symbol.

Figure 4:
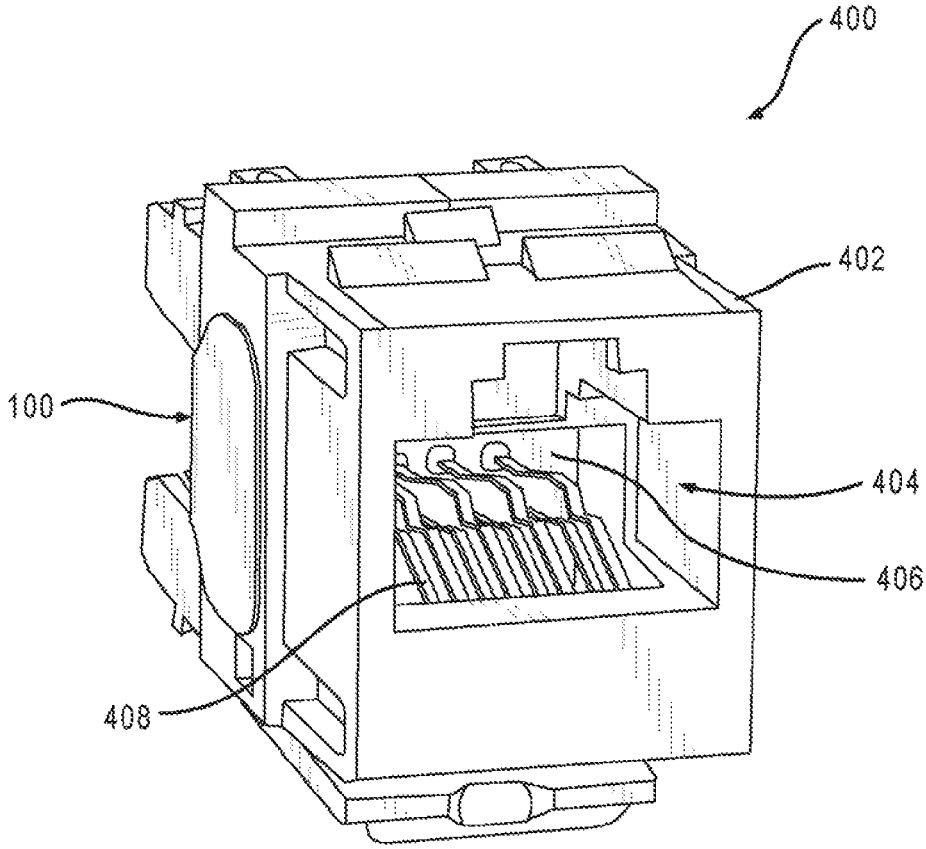
FIG. 4 is a front isometric view of a modular communication connector jack that includes the adhesive laminate label shown in FIG. 1 positioned thereon according to one embodiment of the invention.
Figure 5:
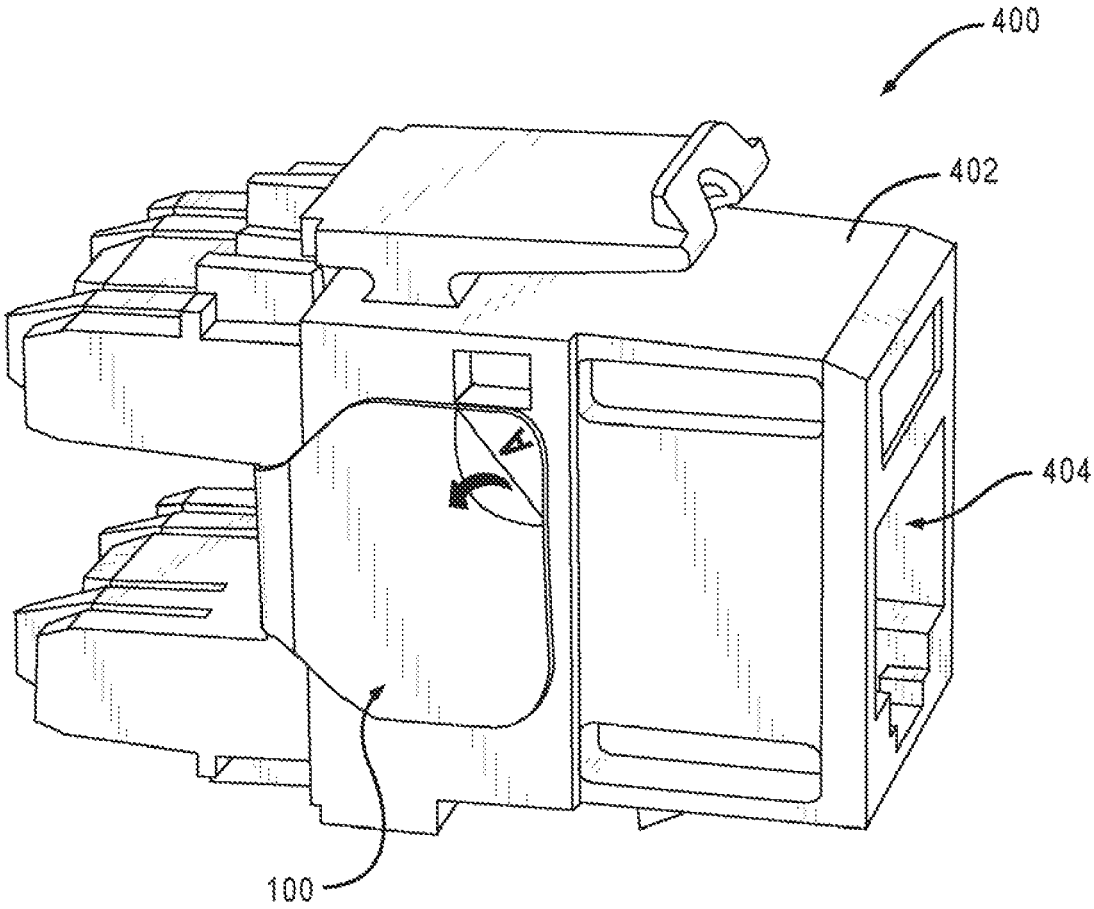
FIG. 5 is a side isometric view of the communication connector jack shown in FIG. 4.

The use of the adhesive laminate label 100 is better understood with reference to a modular communication connector jack 400 shown in FIGS. 4-10. FIGS. 4 and 5 are front and side isometric views, respectively, of the communication connector jack 400 having the adhesive laminate label 100 positioned thereon according to one embodiment of the invention. The illustrated communication connector jack 400 is a Category 6 RJ series electrical connector jack, which is also commonly referred to as an eight position electrical connector jack. However, the adhesive laminate label 100 may be used on a multitude of other types of communication connector jacks besides a Category 6 RJ series electrical connector jack, such as a six or a ten position electrical connector jack. The communication connector jack 400 includes a connector body 402 defining a recess 404 configured to receive a communication plug (not shown), such as a voice/data/video plug. The connector body 402 may also house a printed circuit board 406 or other circuitry, and further houses a plurality of electrical contact tines 408 that may be individually electrically coupled to the printed circuit board 406. Each electrical contact tine 408 projects forwardly from the printed circuit board 406 into the recess 404, and is configured to electrically connect with electrical contacts of the communication plug (not shown) inserted within the recess 404. For example, the communication plug may be a modular connector plug having a tab configured to releasably lock with the connector body 402 when inserted into the recess 404.

Figure 6:
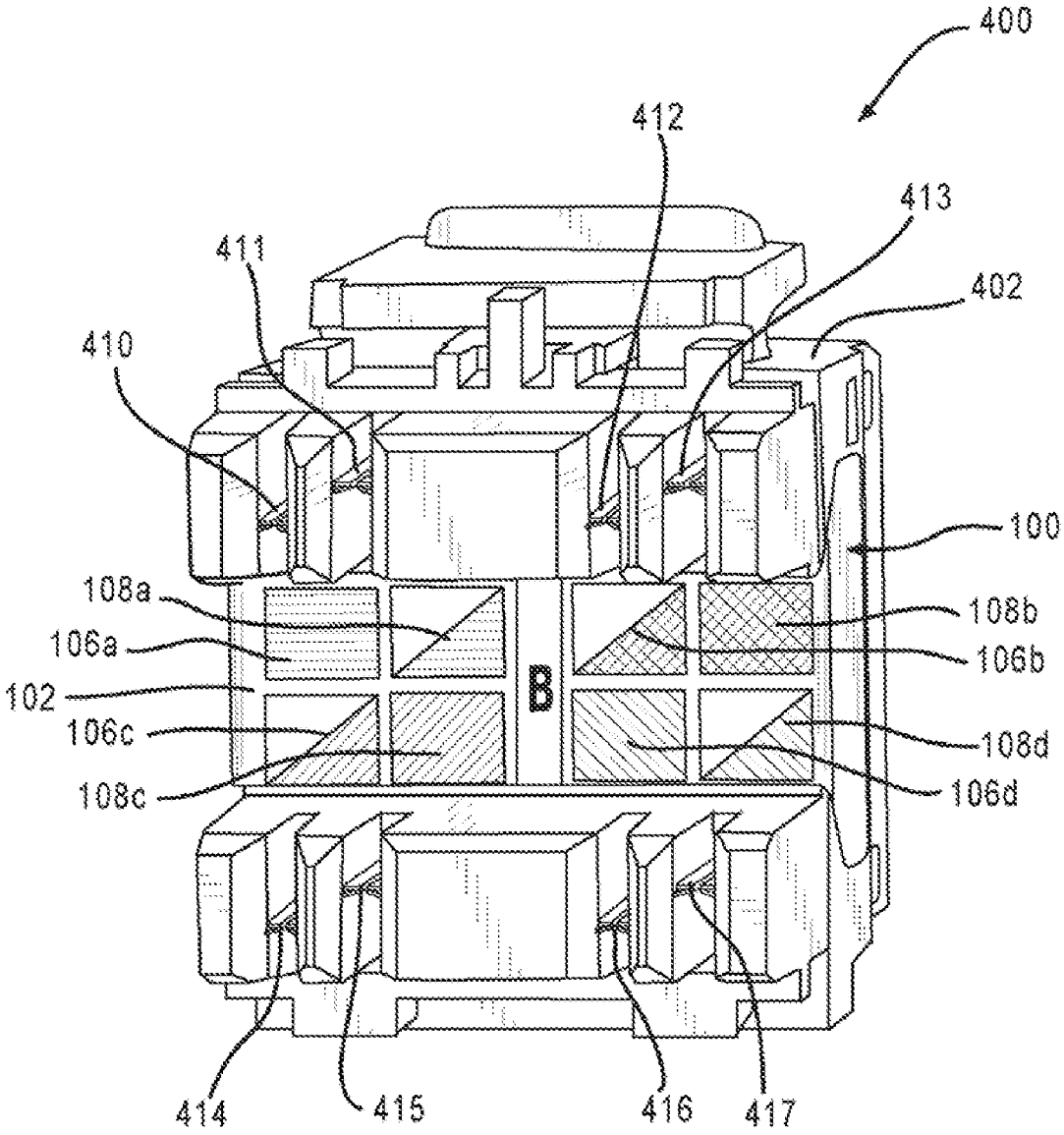
FIG. 6 is a back isometric view of the communication connector jack shown in FIG. 4 that shows the first termination diagram on the upper label of the adhesive laminate label.
Figure 7:
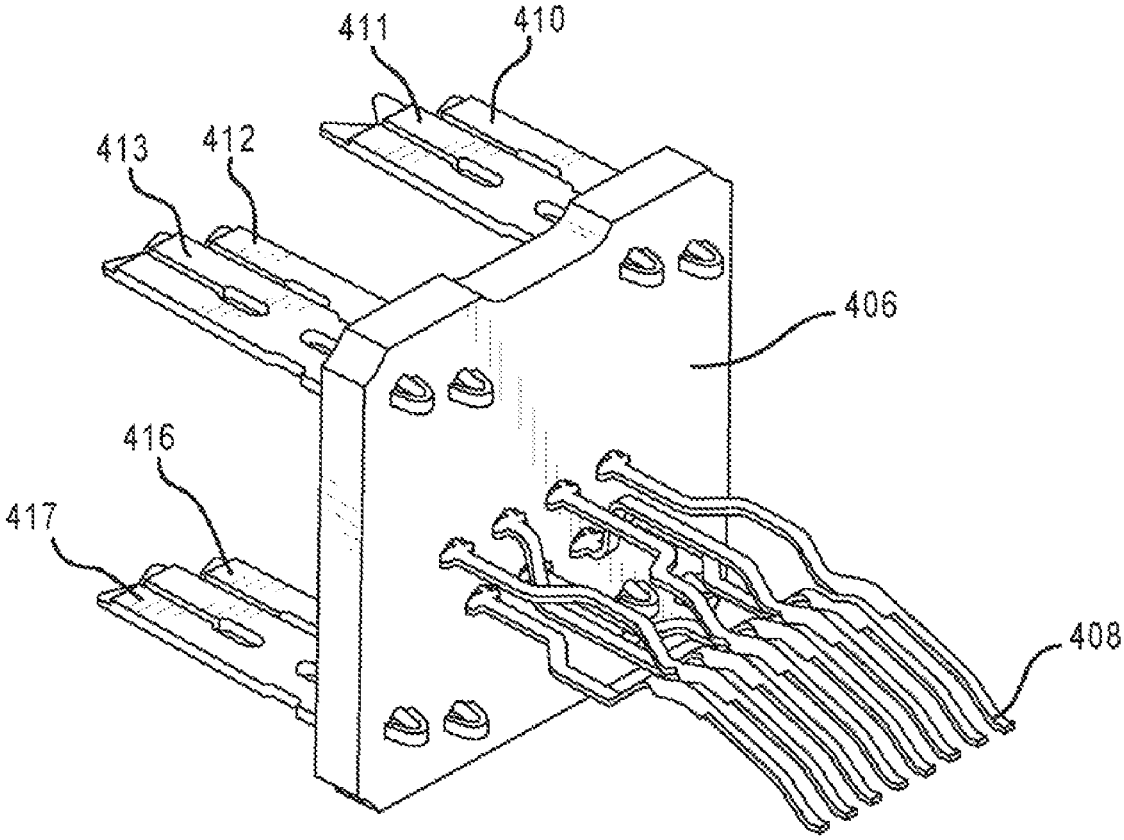
FIG. 7 is an isometric view of the communication connector jack shown in FIGS. 4-6 without the connector body that illustrates the printed circuit board and associated electrical contact tines and insulation displacement contacts.

FIG. 6 is a back isometric view of the communication connector jack 400, and more clearly shows the relationship of the first termination diagram on the upper label 102 of the adhesive laminate label 100 to a plurality of electrical terminals 410-417 (i.e., signal-line terminals) partially enclosed by the connector body 402. Referring to FIG. 7, each electrical terminal 410-417 is connected to and projects rearwardly from the printed circuit board 406. The electrical terminals 410-417 are each configured to be electrically coupled to a corresponding electrical conductor of a multi-conductor cable. Each electrical terminal 410-417 is electrically coupled to a corresponding one of the electrical contact tines 408 via circuitry formed in the printed circuit board 406. Although each electrical terminal 410-417 is shown configured as an insulation displacement contact, other types of electrical terminals may be used. During use, the electrical contact tines 408 carry data signals (e.g., voice, video, and/or data signals) to the communication plug inserted in the recess 404 from the multi-conductor cable connected to the electrical terminals 410-417 and vice versa. It is noted that in other embodiments of the invention, the printed circuit board 406 may be omitted, and each electrical contact tine 408 may be electrically coupled to a corresponding one of the electrical terminals 410-417 without an intervening printed circuit board 406.

Turning again to FIG. 6, the adhesive laminate label 100 may be positioned on a rear portion of the connector body 402 and recessed between the electrical terminals 410-413 and 414-417. The color-coded symbol pairs 104*a*-104*d* (not labeled) on the upper label 102 may be arranged in two rows so that the each color-coded symbol 106*a*-106*d* and 108*a*-108*d* is positioned proximate to a corresponding one of the electrical terminals 410-417 to indicate the type of color-coded electrical conductor of a pair of electrical conductors to terminate.

As can be appreciated from FIG. 6, the color-coded symbols 106*a*-106*d* and 108*a*-108*d* may be sufficiently large and easily readable by the installer that has to perform the tedious and repetitive task of terminating electrical conductors at the electrical terminals 410-417. For example, an installer may have to install several hundred communication connector jacks in a typical day during construction of a building. Often, installation of the communication connector jacks is performed in the dark or under other less than optimal light conditions.

Figure 8:
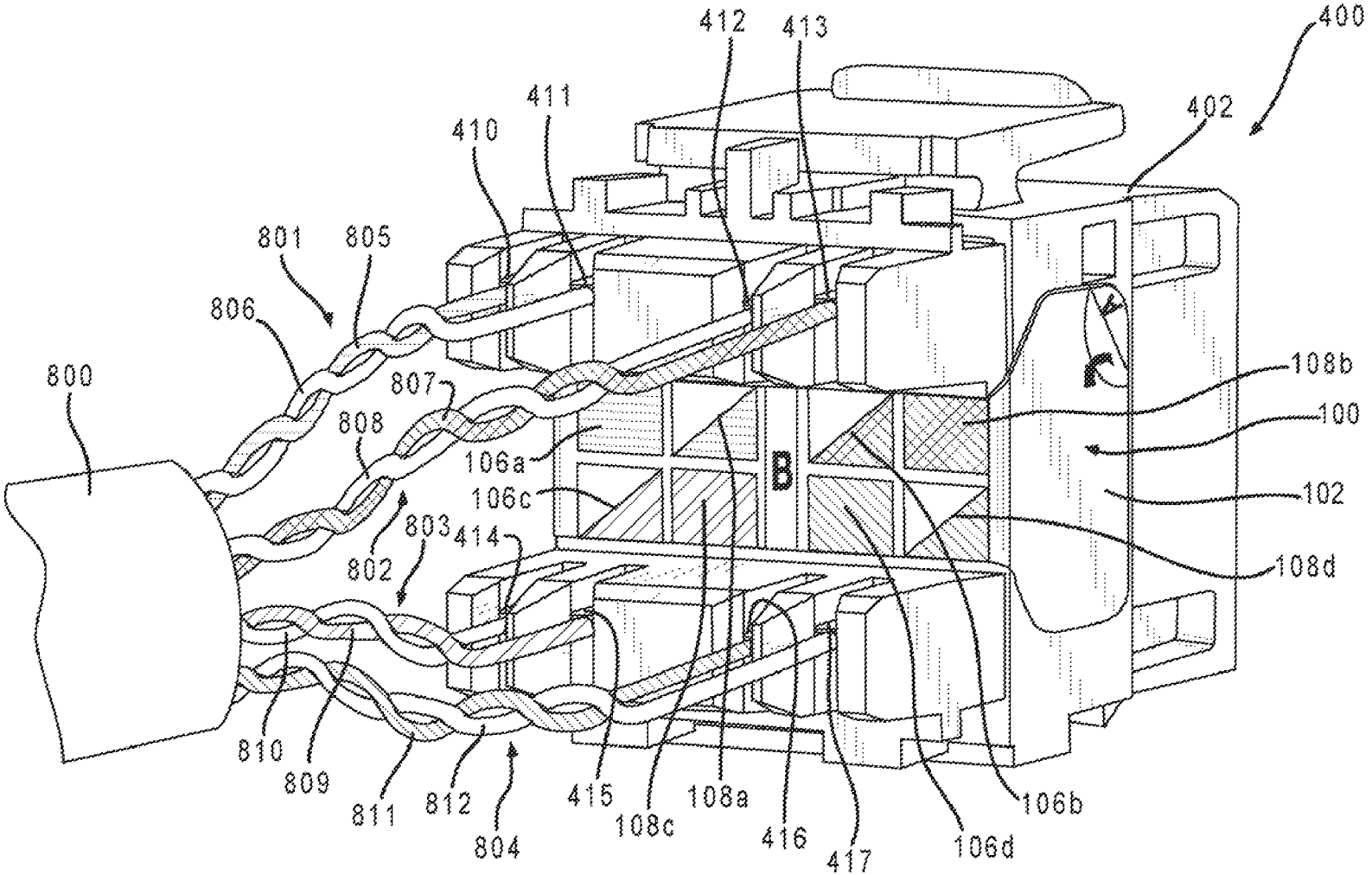
FIG. 8 is a back isometric view of the communication connector jack shown in FIG. 6 in which a multi-conductor cable is terminated according to the T568B standard.

FIG. 8 is a back isometric view of the communication connector jack 400 in which a multi-conductor cable 800 (e.g., a multi-signal-line cable) is terminated at the electrical terminals 410-417 according to the T568B standard of the first wiring pattern on the upper label 102. The multi-conductor cable 800 includes pairs of color-coded electrical conductors 801-804 (e.g., twisted pairs of color-coded electrical conductors). The pair of color-coded electrical conductors 801 is associated with the color-coded symbol pair 104*a* (not labeled), and includes an electrical conductor 805 having blue insulation and an electrical conductor 806 having white insulation. The electrical conductor 805 is terminated at the electrical terminal 410 proximate to the correspondingly color-coded symbol 106*a* and the electrical conductor 806 is terminated at the electrical terminal 411 proximate to the correspondingly color-coded symbol 108*a*. The pair of color-coded electrical conductors 802 is associated with the color-coded symbol pair 104*b* (not labeled), and includes an electrical conductor 807 having orange insulation and an electrical conductor 808 having white insulation. The electrical conductor 807 is terminated at the electrical terminal 413 proximate to the correspondingly color-coded symbol 108*b* and the electrical conductor 808 is terminated at the electrical terminal 412 proximate to the correspondingly color-coded symbol 106*b*.

Still referring to FIG. 8, the pair of color-coded electrical conductors 803 is associated with the color-coded symbol pair 104*c* (not labeled), and includes an electrical conductor 809 having brown insulation and an electrical conductor 810 having white insulation. The electrical conductor 809 is terminated at the electrical terminal 415 proximate to the correspondingly color-coded symbol 108*c* and the electrical conductor 810 is terminated at the electrical terminal 414 proximate to the correspondingly color-coded symbol 106*c*. The pair of color-coded electrical conductors 804 is associated with the color-coded symbol pair 104*d* (not labeled), and includes an electrical conductor 811 having green insulation and an electrical conductor 812 having white insulation. The electrical conductor 811 is terminated at the electrical terminal 416 proximate to the correspondingly color-coded symbol 106*d* and the electrical conductor 812 is terminated at the electrical terminal 417 proximate to the correspondingly color-coded symbol 108*d*.

Figure 9:
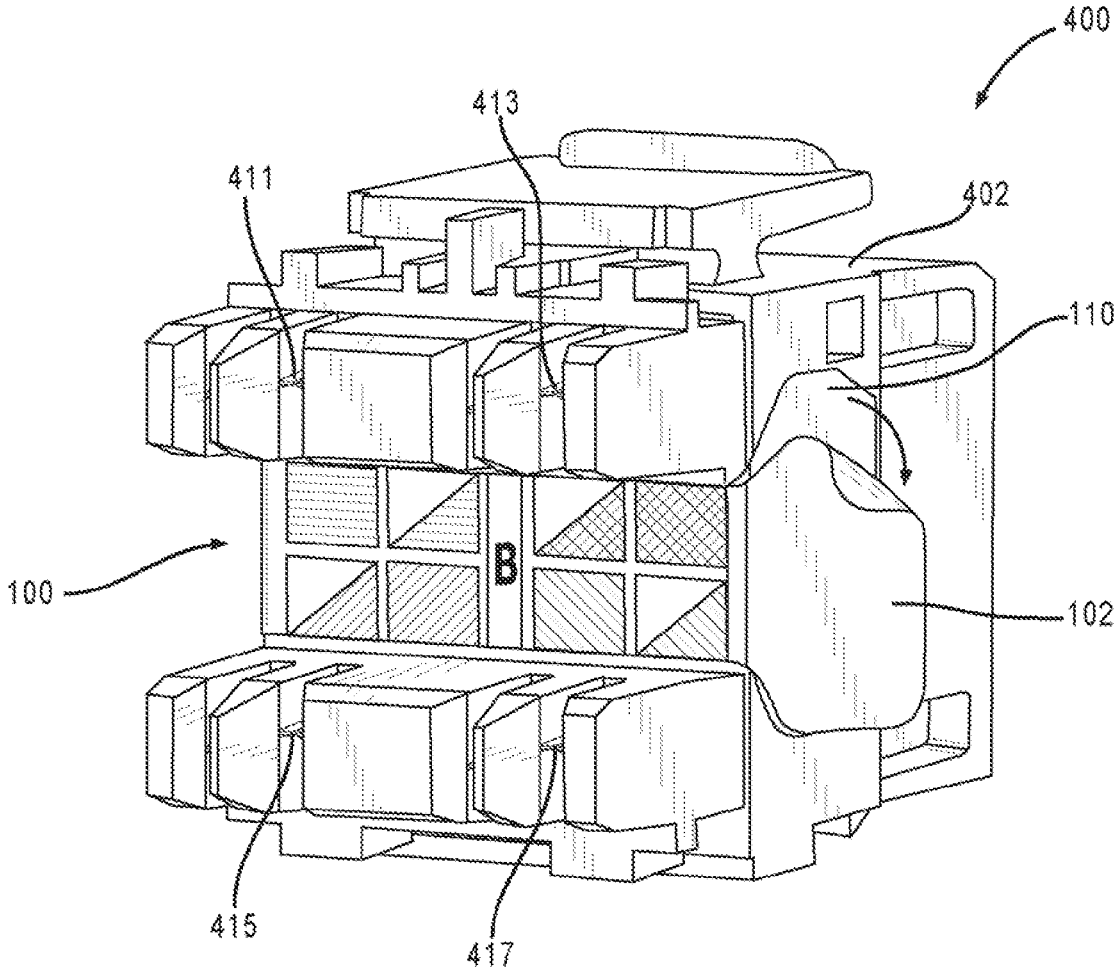
FIG. 9 is a back isometric view of the communication connector jack shown in FIG. 6, with the upper label of the adhesive laminate label being removed from the underlying lower label.
Figure 10:
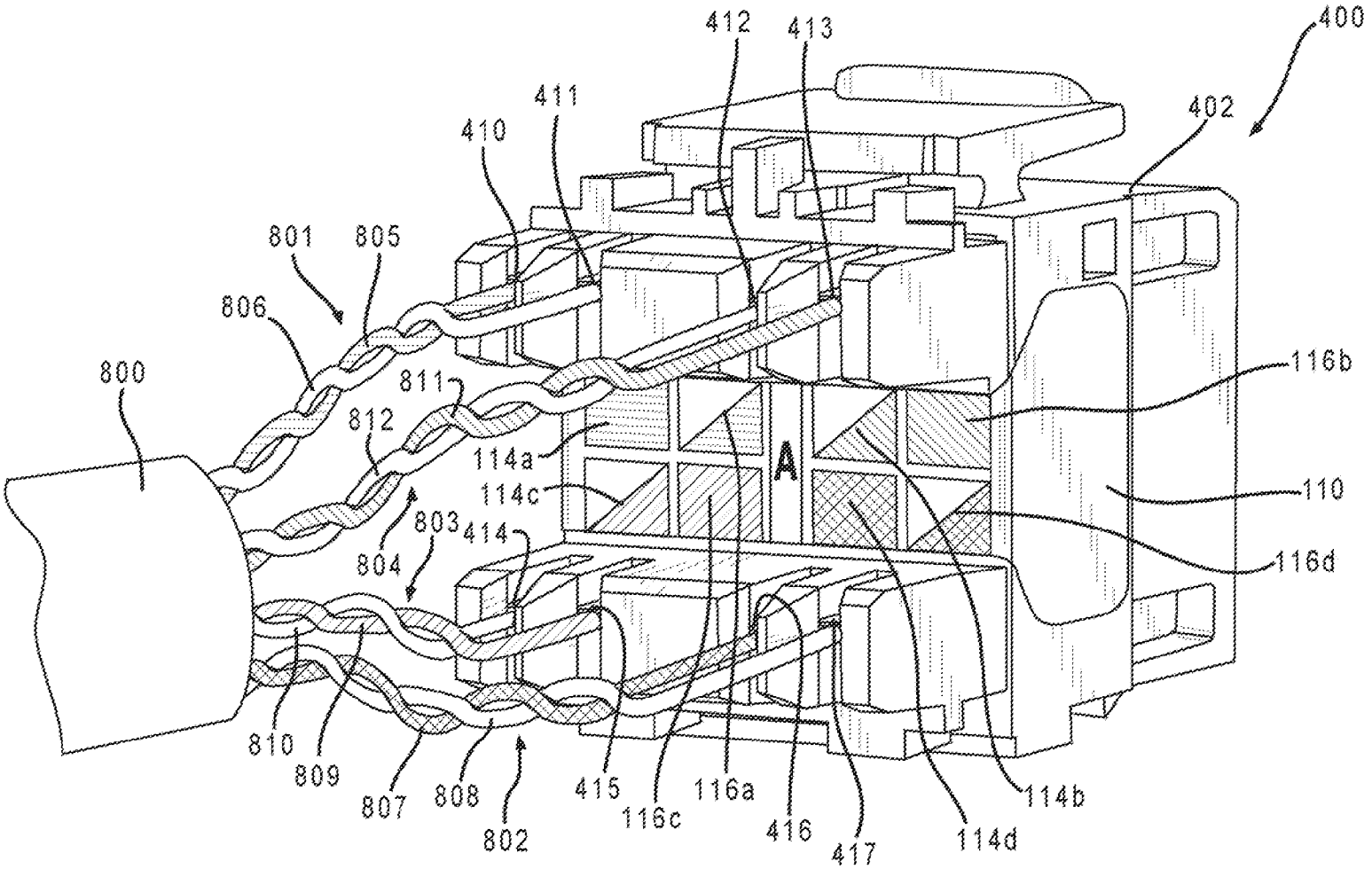
FIG. 10 is a back isometric view of the communication connector jack with the lower label of the adhesive laminate label revealed after removal of the upper label, and a multi-conductor cable terminated according to the T568A wiring standard on the lower label.

Referring to FIG. 9, when the multi-conductor cable 800 is to be terminated according to the second termination diagram on the underlying lower label 110, an installer may remove the upper label 102 of the adhesive laminate label 100 from the underlying lower label 110. FIG. 10 is a back isometric view of the communication connector jack 400 with the lower label 110 of the adhesive laminate label 100 revealed after removal of the upper label 102. As shown in FIG. 10, the color-coded electrical conductors 805-812 of corresponding pairs of color-coded electrical conductors 801-804 may be terminated in accordance with the second termination diagram shown on the lower label 110 that, in the illustrated embodiment, is in accordance with the T568A wiring standard.

Although FIGS. 4-10 illustrates a specific type of configuration for the communication connector jack 400, many other different types of communication connector jack configurations may be employed in combination with the adhesive laminate label 100. For example, in other embodiments of the invention, a connector body of a modular communication connector jack may not have sufficient space between insulation displacement contacts for the adhesive laminate label 100. In such embodiments, the adhesive laminate label 100 may be positioned on a side portion of the connector body, while still providing a termination diagram that an installer can terminate electrical conductors or other types of signal lines at the signal-line terminals. For example, the adhesive laminate label 100 may not be positioned between the signal-line terminals. Thus, as desired or needed, the adhesive laminate label 100 may be positioned on any suitable location of a connector body of a communication connector jack. Moreover, in other embodiments of the invention, electrical terminals or other signal-line terminals of a communication connector jack may be arranged generally in a single row or staggered, as opposed to two rows.

Figure 11:
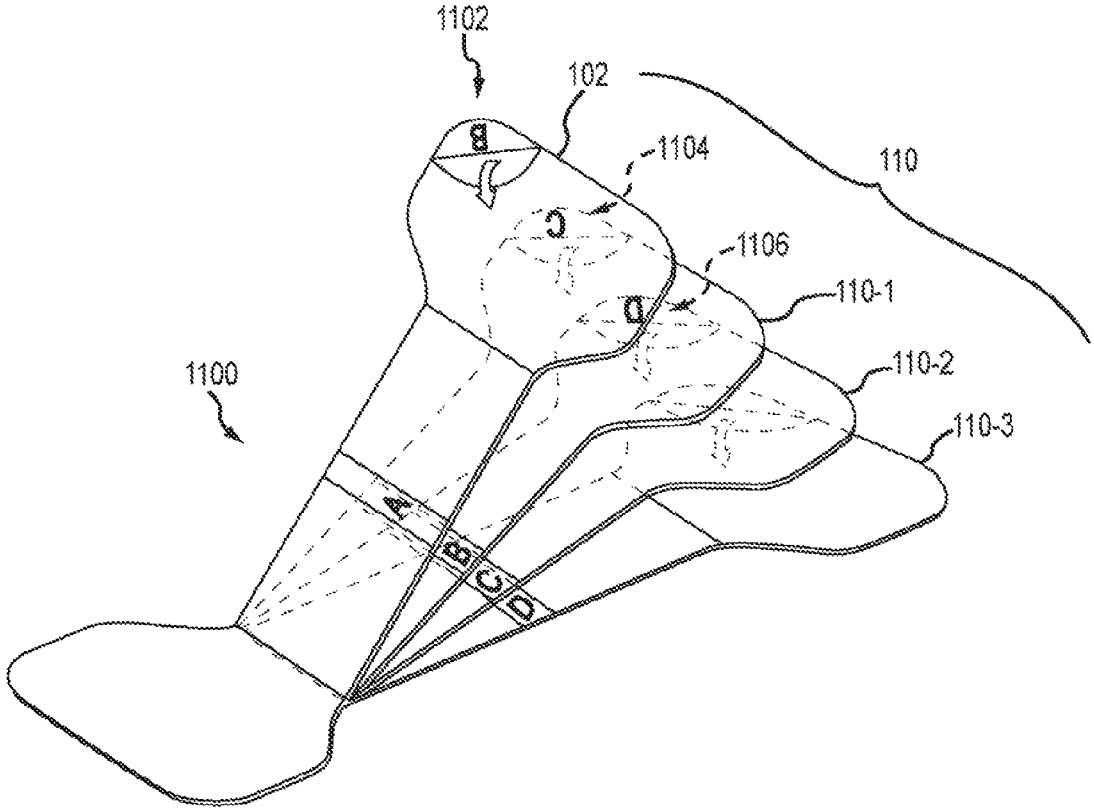
FIG. 11 is an isometric view of an adhesive laminate label including multiple lower labels according to another embodiment of the invention.

FIG. 11 is an isometric view of an adhesive laminate label 1100 including an upper label 102 and multiple lower labels 110 according to another embodiment of the invention. The embodiment of FIG. 11 includes three lower labels 110, which are designated 110-1, 110-2, and 110-3. More than three lower labels 110 or only two lower labels are included in other embodiments of the invention. The upper label 102 and each of the lower labels 110 include visible indicia (not shown) that function to assist an installer or other user of a communications device (not shown) to which the label 1100 is attached to correctly connect signal lines to the communications device. The visible indicia may be, for example, termination diagrams as previously discussed with reference to the adhesive laminate label 100 of FIG. 1. In this situation, each of the upper label 102 and lower labels 110 includes symbol pairs 104*a*-104*d* (not shown in FIG. 11) that include a corresponding color-coded symbol 106*a*-106*d* and a corresponding color-coded symbol 108*a*-108*d*, as illustrated in FIGS. 1-3.

The construction of the adhesive laminate label 1100, such as materials utilized to form the label, will be understood from the more detailed description of the adhesive laminate label 100 provided above with reference to the embodiments shown in FIGS. 1-3. Thus, for the sake of brevity, the construction of the adhesive laminate label 1100 will not be discussed in more detail herein. Briefly, note that in the adhesive laminate label 1100 the upper and lower labels 102, 110 are removably adhered to one another and that a lowermost or final one of the lower labels 110 may or may not include an adhesive on a back side of that final lower label, just as described above regarding the lower label 110 of FIGS. 1-3. In some embodiments it may be desirable for the final lower label 110-3 to include no adhesive on its back side, with the adhesive laminate label 1100 instead being attached to an associated communications device (not shown) through other suitable ways, such as being held in place by pressure applied to the adhesive laminate label from IDCs or other signal line termination contacts on the communications device, or through suitable slots or guides on the communications device.

In the embodiment of FIG. 11, the upper label 102 includes the letter "A" and the lower labels 110-1, 110-2, and 110-3 include the letters "B," "C," and "D," respectively. Each letter A-D represents a corresponding termination diagram that is contained on the corresponding upper label 102 or lower label 110. The upper label 102 further includes a marking 1102 and each of the lower labels 110-1 and 110-2 also include similar markings 1104 and 1106, respectively. The markings 1102-1106 are positioned at a corner of the corresponding label 102, 110, and indicate the presence of another termination diagram on the underlying label along with information about that other termination diagram. The precise locations of the markings 1102-1106 on their respective labels may of course vary, as may the specific visual information conveyed by respective markings.

The marking 1102 is the letter "B" to indicate that the termination diagram contained on the immediate underlying lower label, lower label 110-1 in this case, is in accordance with some wiring standard associated with the letter "B." Similarly, the marking 1104 is the letter "C" to indicate that the termination diagram contained on the immediate underlying lower label, lower label 110-2 in this case, is in accordance with some wiring standard associated with the letter "A." Finally, the marking 1106 is the letter "D" to indicate that the termination diagram contained on the immediate underlying lower label, lower label 110-3 in this case, is in accordance with some wiring standard associated with the letter "D."

Figure 12:
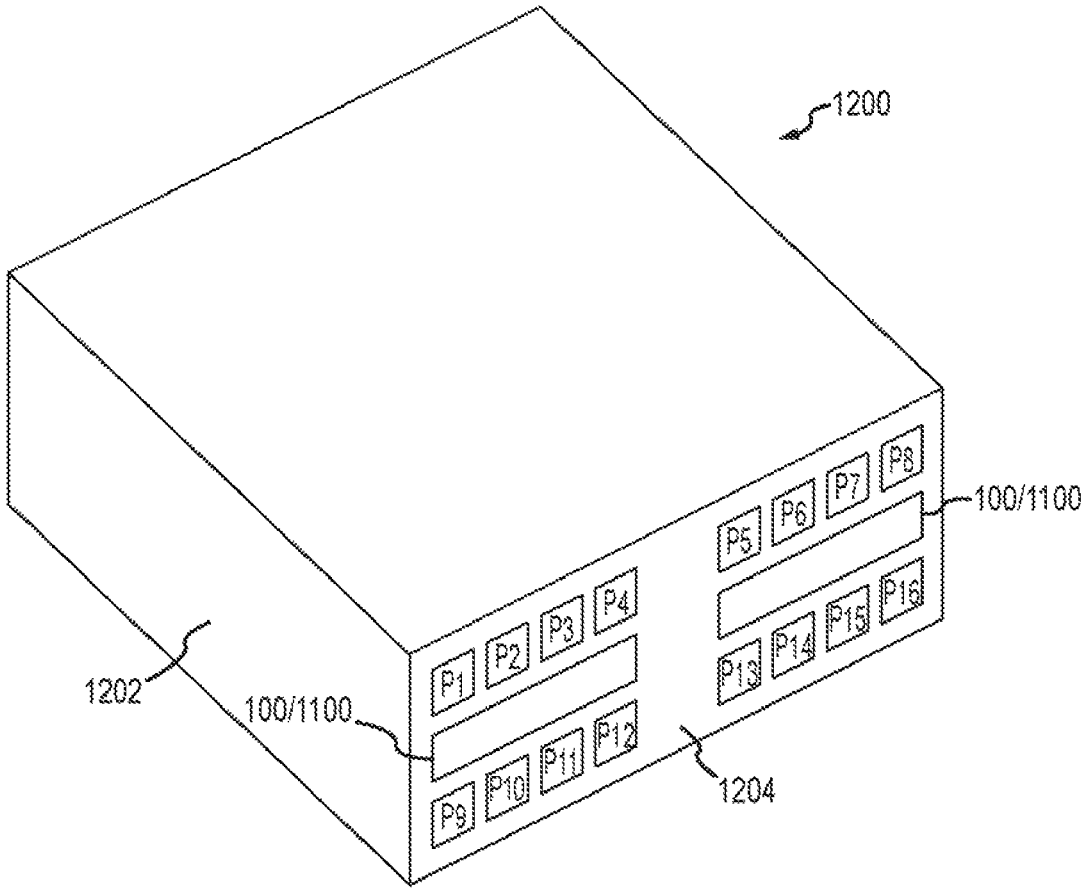
FIG. 12 is an isometric view of a communications device including two adhesive laminate labels of FIGS. 1 and/or 11 positioned thereon according to another embodiment of the invention.

FIG. 12 is an isometric view of a communications device 1200 including two adhesive laminate labels 100 and/or 1100 of FIGS. 1 and 11 positioned thereon according to another embodiment of the invention. The communications device 1200 may be any type of device that includes signal line termination ports P to which signal lines are connected and where utilization of the adhesive laminate labels 100/1100 may assist an installer or other user of the device to properly connect signal lines to the device. In the example of FIG. 12, the communications device 1200 includes a housing 1202 having a faceplate 1204 through which a number of ports P1-P16 are accessed. The ports P1-P16 are arranged in two rows on the faceplate 1204, with ports P1-P4 and P5-P8 being contained in a first row and ports P9-P12 and P13-P16 being contained in a second row. A first one of the adhesive laminate labels 100/1100 is positioned on the faceplate 1204 between the ports P1-P4 and P9-P12. The second one of the adhesive laminate labels 100/1100 is positioned on the faceplate 1204 between the ports P5-P8 and P13-P16. Adhesive laminate labels 100/1100 may also be a single elongated label positioned on the faceplate 1204 and extending between the ports P1-P8 and P9-P16. Each of these adhesive laminate labels 100/1100 includes visible indicia, which are not shown in FIG. 12, to assist an installer or other user of the communications device 1200 in connecting signal lines to the ports P1-P16. The installer or other user removes the upper and lower labels of the adhesive laminate labels 100/1100 until the desired termination diagram is exposed and thereafter connects signal lines to the ports P1-P16 pursuant to the exposed termination diagram. In one embodiment, the communications device 1200 is a "fiber box" that interconnects fiber optic cables in applications requiring patching, cross-connect, and/or splicing of single mode and multimode fiber optic cables, as will be appreciated by those skilled in the art.

Figure 13:
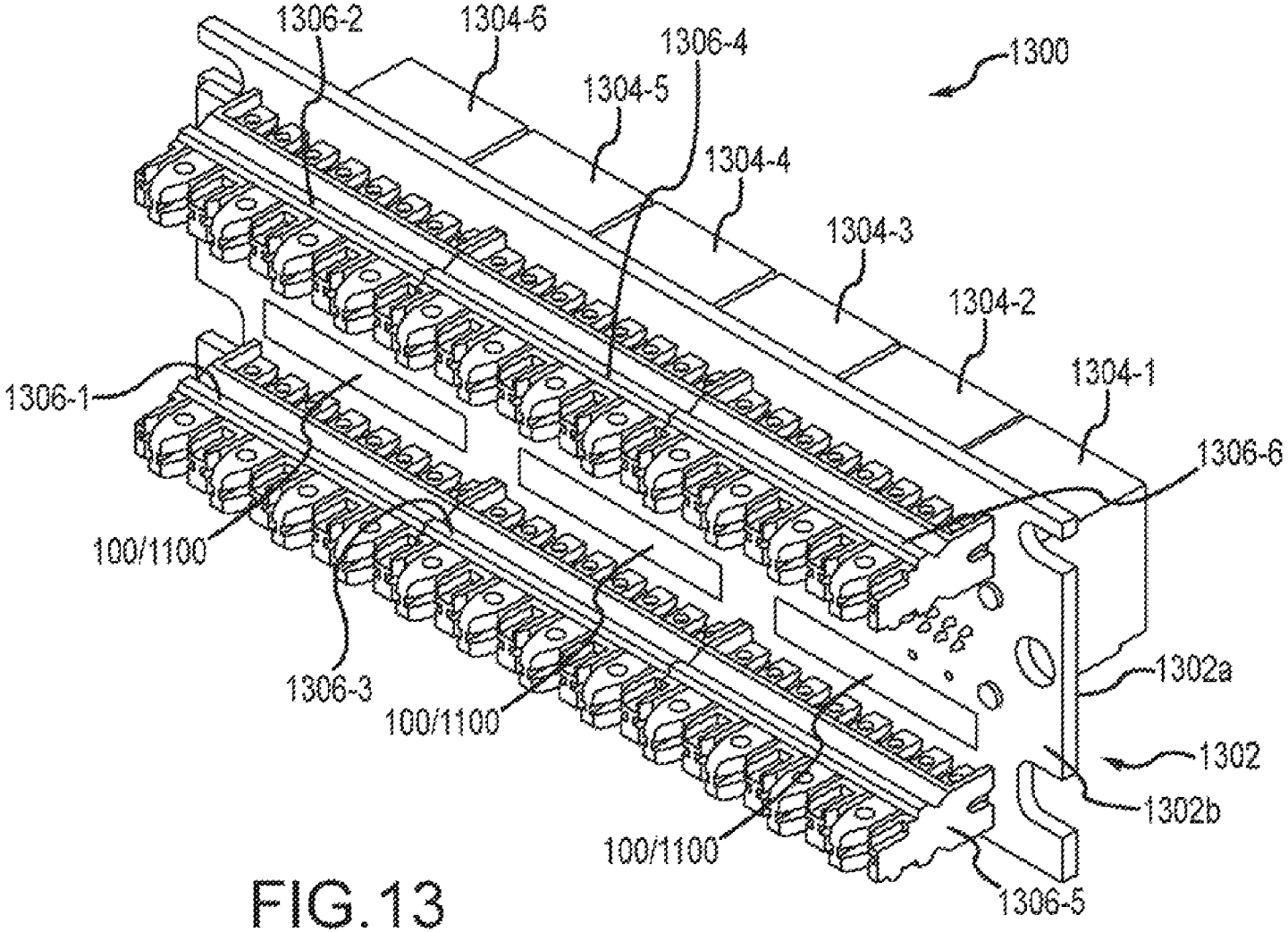
FIG. 13 is an isometric view of a patch panel including the adhesive laminate label of FIGS. 1 and/or 11 positioned thereon between rows of insulation displacement connectors (IDCs) according to another embodiment of the invention.

FIG. 13 is an isometric view of a patch panel 1300 including the adhesive laminate labels 100 and/or 1100 of FIGS. 1 and 11 positioned thereon between rows of insulation displacement connectors (IDCs) according to another embodiment of the invention. The patch panel 1300 includes a circuit board 1302 having a front side 1302*a* to which a number of communication connector jacks 1304-1 to 1304-6 are attached. The circuit board 1302 has a back side 1302*b* to which a number of insulation displacement connectors (IDCs) 1306-1 to 1306-6 are attached. Electrical components within the communication connector jacks 1304 are electrically connected to electrical components of the IDCs 1306 through conductive traces (not shown) of the circuit board

1302. The IDCs 1306-2, 1306-4, and 1306-6 form a first row of IDCs on the backside 1302*b* of the circuit board 1302 while IDCs 1306-1, 1306-3, and 1306-5 form a second row of IDCs. Three adhesive laminate labels 100 and/or 1100 of the embodiments of FIGS. 1 and 11, respectively, are attached to the back side 1302*b* of circuit board 1302 between the rows of IDCs 1306 as shown. Adhesive laminate labels 100/1100 may also be a single elongated label positioned on the back side 1302*b* and extending between the row of IDCs 1306-2 to IDCs 1306-6 and the row of IDCs 1306-1 to IDCs 1306-5. An installer removes the upper label and one or more of the lower labels as appropriate to expose the desired termination diagram contained on the labels 100/1100, and thereafter connects signal lines to the IDCs 1306 according to the exposed termination diagrams.

Figure 14:
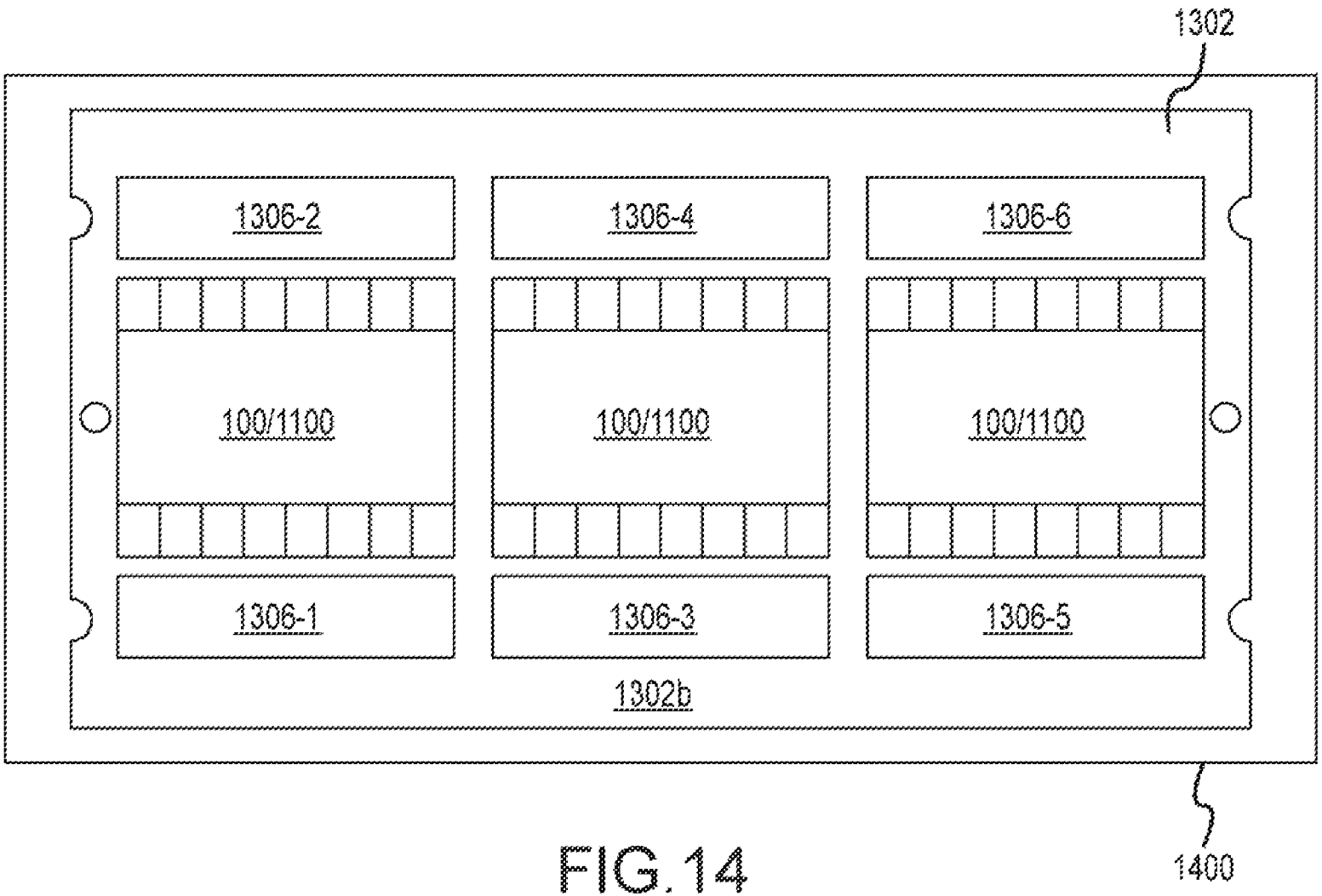
FIG. 14 is a rear view of the patch panel of FIG. 13 illustrating in more detail the positioning of the adhesive laminate label of FIGS. 1 and/or 11 between the rows of IDCs.

FIG. 14 is a rear view of the patch panel 1300 of FIG. 13 illustrating in more detail the positioning of the adhesive laminate labels 100/1100 of FIGS. 1 and 11 between the rows of IDCs 1306 on the back side 1302*b* of the circuit board 1302. Each adhesive laminate label 100/1100 includes termination diagrams represented as squares along the upper and lower edges of the label. In the example illustrated, a single adhesive laminate label 100/1100 therefore includes the termination diagram for the upper IDC 1306 and lower IDC positioned adjacent the adhesive laminate label. For example, the adhesive laminate label 100/1100 on the far left of the circuit board 1302 contains termination diagrams for the IDC 1306-2 and IDC 1306-1. In another embodiment, the adhesive laminate labels 100/1100 are still positioned between the rows of IDCs 1306 but for each IDC a separate adhesive laminate label is affixed to the backside 1302*b* of the circuit board 1302 adjacent that IDC. Adhesive laminate labels 100/1100 may also be a single elongated label positioned on the back side 1302*b* and extending between the row of IDCs 1306-2, 1306-4, 1306-6 and the row of IDCs 1306-1, 1306-3, 1306-5. FIG. 14 also illustrates a housing 1400, which is not shown in FIG. 13, to which the circuit boards 1302 of the patch panel 1300 are typically connected, as will be appreciated by those skilled in the art. One skilled in the art will understand the detailed construction and operation of the patch panel 1300 and thus, for the sake of brevity, the patch panel will not be described in more detail herein.

Note that although the patch panel 1300 is shown and described as including IDCs, other types of wire termination contacts could be utilized in place of the IDCs, such as terminals, bonding pads, soldering, vias or through holes, and so on. The same is true for the ports P of the communications device 1200 of FIG. 12, where each of these ports may be any suitable type of wire termination contact and may also be other types of ports such as fiber optic ports.

The teachings disclosed herein may also be employed with other signal lines besides electrical conductors. For example, in an optical communication connector jack, optical fibers may be terminated according to a termination diagram on a label of an adhesive laminate label at signal-line terminals. In such an embodiment, each optical fiber is terminated at a corresponding ferrule (i.e., a signal-line terminal) housed by a connector body and the connector body is configured to receive or otherwise interface with an optical communication plug.

The principles of the embodiments disclosed herein are also applicable to patch panels including multiple communication connector jacks, face plates, ceiling enclosures, floor boxes, and many other different applications of the disclosed adhesive laminate labels and communication connector jacks. Also note that the term "adhesive laminate label" is not meant to indicate a particular type of label, but is intended as a functional descriptive name for any suitable label that may be formed to include multiple layers adhered to one another and that may be attached to a communications device as described with reference to the various embodiments of the invention described above.

While various aspects and embodiments of the invention have been disclosed herein, other aspects and embodiments will be apparent to those skilled in the art. The various aspects and embodiments disclosed herein are for purposes of illustration and are not intended to be limiting.

The invention claimed is:

1. An adhesive laminate label for a communications device, comprising:

an upper label including visible indicia;

at least one lower label, each of the lower labels including corresponding visible indicia that are different than the visible indicia of the upper label and of the other lower labels, and wherein at least the visible indicia of each lower label are covered by either the upper label or one of the other lower labels and wherein the upper and lower labels are removably adhered to one another; and wherein the upper label and each lower label are configured to fit between first and second rows of signal-line termination ports of the communications device.

2. The adhesive laminate label of claim 1 wherein at least some of the visible indicia on the upper and lower labels are termination diagrams.

3. The adhesive laminate label of claim 2 wherein at least some of the termination diagrams comprise a plurality of color-coded symbol pairs.

4. The adhesive laminate label of claim 3 wherein at least some of the plurality of color-coded symbol pairs are arranged in two rows to form the corresponding termination diagram.

5. The adhesive laminate label of claim 2 wherein each of the termination diagrams is in accordance with a corresponding wiring standard.

6. The adhesive laminate label of claim 1, wherein the upper label comprises a marking thereon that indicates the presence of the first lower label to which the upper label is removably adhered; and wherein at least some of the lower labels include similar markings thereon that indicate the presence of another lower label to which a given lower label is removably adhered.

7. The adhesive laminate label of claim 1 wherein the adhesive laminate label includes a plurality of lower labels.

8. The adhesive laminate label of claim 7 wherein a lowermost one of the adhesive labels includes adhesive on a back side of that lowermost adhesive label.

9. The adhesive laminate label of claim 7 wherein a lowermost one of the adhesive labels does not include adhesive on a back side of that lowermost adhesive label.

10. The adhesive laminate label of claim 1 wherein the adhesive laminate label includes a single lower label.

11. The adhesive laminate label of claim 10 wherein the lower label includes adhesive on a back side of the lower label.

12. The adhesive laminate label of claim 10 wherein the lower label does not include adhesive on a back side of the lower label.

13. A communications device, comprising:

a device body including at least one signal line termination port; and at least one adhesive laminate label positioned on the device body, each adhesive laminate label including:

an upper label including visible indicia; and at least one lower label, each of the lower labels including corresponding visible indicia that are different than the visible indicia of the upper label and of the other lower labels, and wherein at least the visible indicia of each lower label are covered by either the upper label or one of the other lower labels and wherein the upper and lower labels are removably adhered to one another.

14. The communications device of claim 13 wherein the communications device comprises a fiber optic box and wherein each of the signal line termination ports comprises a fiber optic port.

15. The communications device of claim 13 wherein the communications device comprises a patch panel and wherein each of the signal line termination ports comprises a plurality of wire termination contacts associated with a corresponding communication connector jack.

16. The communications device of claim 13 wherein each of the signal line termination ports comprises a plurality of insulation displacement contacts.

17. The communications device of claim 13 wherein the device body includes a plurality of signal line termination ports arranged in first and second rows, and wherein each adhesive laminate label is positioned between the first and second rows of signal line termination ports.

18. The communications device of claim 13 wherein each upper and lower label includes a corresponding termination diagram and wherein each adhesive laminate label is mounted on the body so the termination diagrams of the associated upper and lower labels are positioned proximate to a corresponding one of the signal line termination ports.

19. The communications device of claim 13 wherein the adhesive laminate label includes a plurality of lower labels.

20. The communications device of claim 13 wherein at least some of the visible indicia on the upper and each lower label are termination diagrams.

21. The communications device of claim 20 wherein at least some of the termination diagrams comprise a plurality of color-coded symbol pairs.

22. The communications device of claim 21 wherein at least some of the plurality of color-coded symbol pairs are arranged in two rows to form the corresponding termination diagram.

23. The communications device of claim 13, wherein the upper label comprises a marking thereon that indicates the presence of the first lower label to which the upper label is removably adhered; and wherein at least some of the lower labels include similar markings thereon that indicate the presence of another lower label to which a given lower label is removably adhered.

24. A patch panel, comprising:

at least one circuit board, each circuit board including first and second sides and including a plurality of electrically conductive traces;

a plurality of communication connector jacks, each communication connector jack physically connected to the first side of a corresponding circuit board;

a plurality of wire termination contacts, each wire termination contact physically connected to the second side of a corresponding circuit board, the wire termination contacts arranged in at least one row on the second side of each circuit board and the communication connector jacks connected to a given circuit board electrically coupled to the wire termination contacts connected to that circuit board through the electrically conductive traces of that circuit board; and at least one adhesive laminate label attached to the patch panel, each adhesive laminate label being attached so the adhesive laminate label is adjacent to at least some of the wire termination contacts, and each adhesive laminate label including:

an upper label including visible indicia; and at least one lower label, each of the lower labels including corresponding visible indicia that are different than the visible indicia of the upper label and of the other lower labels, and wherein at least the visible indicia of each lower label are covered by either the upper label or one of the other lower labels and wherein the upper and lower labels are removably adhered to one another.

25. The patch panel of claim 24 further comprising a housing physically connected to the circuit board.

26. The patch panel of claim 24 wherein each adhesive laminate label is attached to a corresponding one of the circuit boards.

27. The patch panel of claim 26 wherein at least some of the wire termination contacts are insulation displacement connectors.

28. The patch panel of claim 24 wherein at least some of the visible indicia on the upper and lower labels are termination diagrams.

29. The patch panel of claim 28 wherein at least some of the termination diagrams comprise a plurality of color-coded symbol pairs.

30. The patch panel of claim 29 wherein at least some of the plurality of color-coded symbol pairs are arranged in two rows on each label to form the corresponding termination diagram.

31. The patch panel of claim 24 wherein for each adhesive laminate label, the upper label comprises a marking thereon that indicates the presence of the first lower label to which the upper label is removably adhered; and at least some of the lower labels include similar markings thereon that indicate the presence of another lower label to which a given lower label is removably adhered.

32. The patch panel of claim 24 wherein at least some of the adhesive laminate labels include a plurality of lower labels.

33. The patch panel of claim 32 wherein for each adhesive laminate label including a plurality of lower labels a lowermost one of the lower labels does not include adhesive on a back side of the lowermost lower label.

34. The patch panel of claim 32 wherein for each adhesive laminate label including a plurality of lower labels a lowermost one of the lower labels includes adhesive on a back side of the lowermost lower label.

35. The patch panel of claim 24 wherein at least some of the adhesive laminate labels include a single lower label.

36. The patch panel of claim 35 wherein for each adhesive laminate label including a single lower label that single lower label does not include adhesive on a back side of the single lower label.

37. The patch panel of claim 35 wherein for each adhesive laminate label including a single lower label that single lower label includes adhesive on a back side of the single lower label.

38. A method, comprising:

selectively displaying only one termination diagram of at least two termination diagrams of an adhesive laminate label affixed to a patch panel; and terminating a plurality of signal lines at corresponding wire termination contacts of the patch panel in accordance with the selectively displayed termination diagram.

39. The method of claim 38 further comprising physically attaching the adhesive laminate label to the patch panel prior to the operations of selectively displaying and terminating.

40. The method of claim 38 wherein selectively displaying only one termination diagram of at least two termination diagrams of an adhesive laminate label affixed to the patch panel comprises peeling an upper label having a first termination diagram off of an underlying lower label having a second termination diagram that is different than that of the first termination diagram until the desired termination diagram is displayed.

41. The method of claim 40 wherein terminating each of the signal lines at a corresponding one of the wire termination contacts in accordance with the second termination diagram comprises terminating each of the signal lines at a corresponding one of the wire termination contacts located proximate to a correspondingly color-coded symbol of the second termination diagram.

42. The method of claim 38 wherein:

selectively displaying comprises leaving an upper label having a first termination diagram at least partially covering an underlying lower label having a second termination diagram that is different than that of the first termination diagram; and terminating comprises terminating each of the signal lines at a corresponding one of the signal-line terminals in accordance with the first termination diagram.

43. The method of claim 42 wherein terminating comprises terminating each of the signal lines at a corresponding one of the wire termination contacts located proximate to a correspondingly color-coded symbol of the first termination diagram.

44. A method, comprising:

physically attaching an adhesive laminate label to a patch panel having a plurality of rows of wire termination contacts on one side of the patch panel, the adhesive laminate label including:

an upper label including visible indicia; and at least one lower label, each of the lower labels including corresponding visible indicia that are different than the visible indicia of the upper label and of the other lower labels, and wherein at least the visible indicia of each lower label are covered by either the upper label or one of the other lower labels, wherein the upper and lower labels are removably adhered to one another, and wherein each of the upper and lower labels is formed so as to fit between adjacent rows of wire termination contacts.

45. The method of claim 44 further comprising:

selectively displaying only one termination diagram of at least two termination diagrams of the adhesive laminate label affixed to the patch panel; and terminating a plurality of signal lines at corresponding wire termination contacts of the patch panel in accordance with the selectively displayed termination diagram.

46. The method of claim 45 wherein at least some of the termination diagrams comprise a plurality of color-coded symbol pairs.

* * * * *